United States Patent [19]

Cottell

[11] 4,048,963

[45] Sept. 20, 1977

[54] COMBUSTION METHOD COMPRISING BURNING AN INTIMATE EMULSION OF FUEL AND WATER

[76] Inventor: Eric Charles Cottell, P.O. Box 1415, Bayville, Long Island, N.Y. 11709

[21] Appl. No.: 579,399

[22] Filed: May 21, 1975

Related U.S. Application Data

[60] Continuation-in-part of Ser. No. 489,710, July 18, 1974, abandoned, which is a continuation-in-part of Ser. No. 280,967, Aug. 16, 1972, abandoned, which is a division of Ser. No. 122,632, March 1, 1971, Pat. No. 3,749,318.

[51] Int. Cl.[2] ..... F02D 19/00

[52] U.S. Cl. ..... 123/25 R; 123/25 A; 239/102; 431/1

[58] Field of Search ..... 123/25 R, 25 A, 25 E, 123/1 A; 261/DIG. 48; 137/604; 239/102, 4; 431/1, 4

[56] References Cited

U.S. PATENT DOCUMENTS

| | | | |
|---|---|---|---|
| 2,704,535 | 3/1955 | Magui | 123/25 A |
| 2,947,886 | 8/1960 | McGunegll | 239/102 |
| 2,949,900 | 8/1960 | Bodine | 239/102 |
| 3,070,313 | 12/1962 | Fortman | 239/102 |
| 3,145,931 | 8/1964 | Cleall | 431/1 |
| 3,200,873 | 8/1965 | Young | 239/102 |
| 3,374,953 | 3/1968 | Bodine | 239/102 |
| 3,606,868 | 9/1971 | Voogd | 123/25 A |
| 3,658,302 | 4/1972 | Dulhion | 239/102 |

*Primary Examiner*—Ronald H. Lazarus
*Attorney, Agent, or Firm*—Robert Ames Norton; Saul Leitner

[57] ABSTRACT

A combustion process in which a water-in-oil emulsion of liquid fuel, such as liquid hydrocarbons, containing from 10 to 50% water and preferably 10 to 30% water is burned. The emulsion is produced, with little or no added emulsifying agent, by sonic agitation, including a sonic generator and an acoustic transformer having a larger cross-section coupled to or in contact with the sonic generator than at its other end, at which emulsification takes place, whereby the sonic energy density is increased. With the increased sonic density an emulsion is produced which when burned produces a quality of burn such that the combustion is faster, more complete, and cleaner, with an increase in efficiency even up to 30% of water. The increase in efficiency often equals that obtained by the burning of the same weight of pure fuel in the conventional manner.

5 Claims, 4 Drawing Figures

FIG. 1
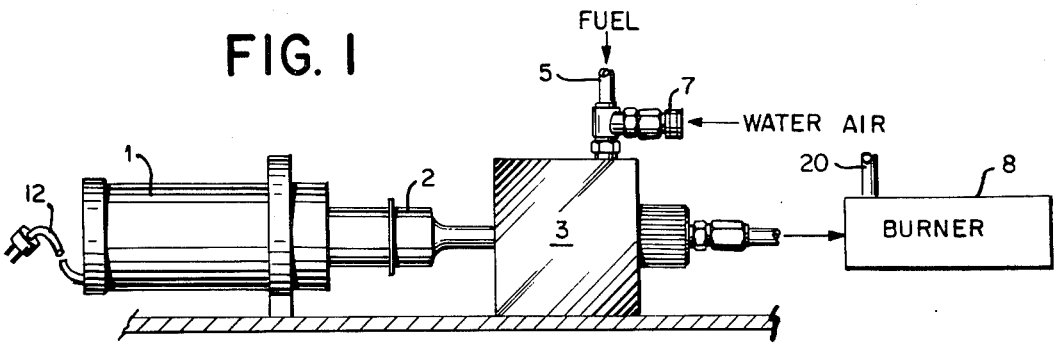
FIG. 2
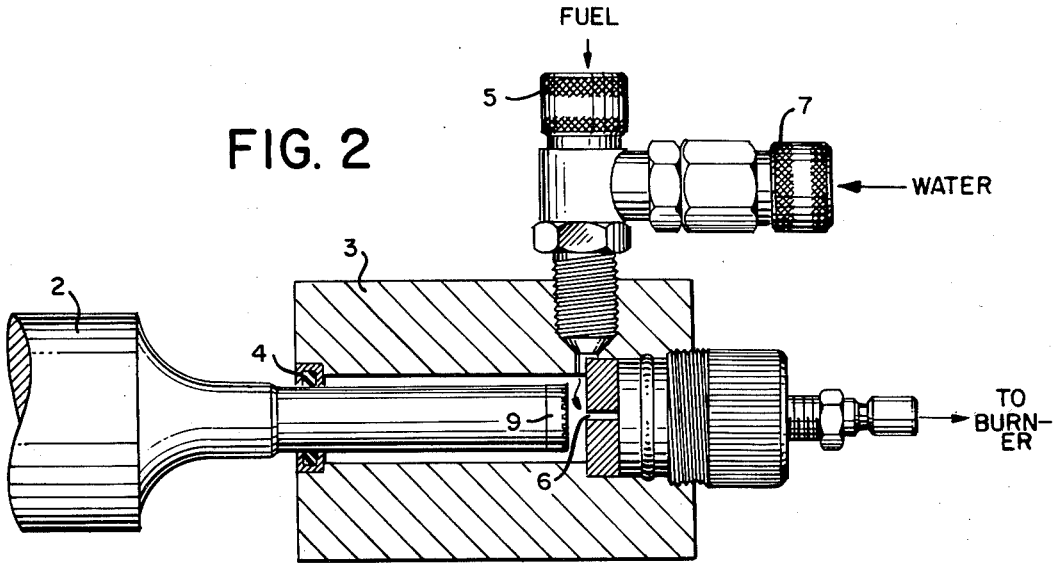
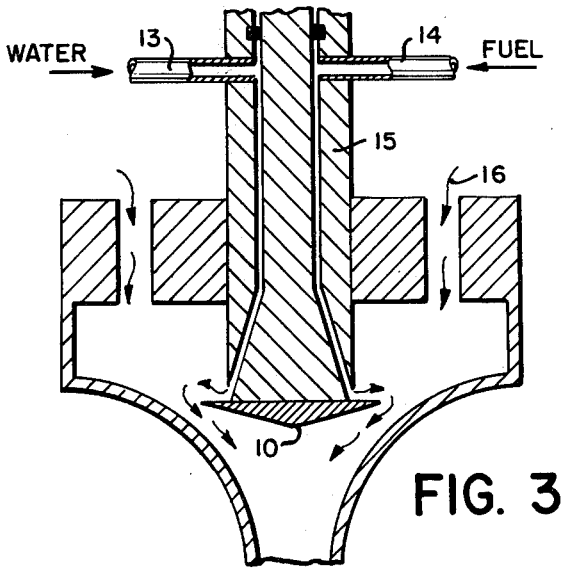
FIG. 3

COMBUSTION METHOD COMPRISING BURNING AN INTIMATE EMULSION OF FUEL AND WATER

RELATED APPLICATIONS

This application is a continuation-in-part of my earlier application Ser. No. 489,710, filed July 18, 1974, which application in turn was a continuation-in-part of my application Ser. No. 280,967, filed Aug. 16, 1972, and which was a division of my application Ser. No. 122,632, filed Mar. 1, 1971, which is now U.S. Pat. No. 3,749,318, July 31, 1973. All of the earlier applications above referred to except Ser. No. 122,632 are now abandoned.

BACKGROUND OF THE INVENTION

The combustion of liquid fuel, such as liquid hydrocarbons, is a standard method of power and/or heat generation. The combustion may be in a system where the heat is transferred to another medium, such as water, with or without boiling the water, or the fuel may be burned in various types of internal combustion engines, such as those operating on Otto, diesel, or other cycle. The amount of oxygen, usually air, is at least about theoretically sufficient for complete combustion of the fuel elements.

Considerable problems have arisen. If there is a very large excess of oxygen, the efficiency of the combustion process is lowered because a considerable amount of air, including inert nitrogen, has to be heated up. In the case of an internal combustion engine also operating with excessive excesses of oxygen can result in slow combustion, which can overheat and burn out exhaust valves. If the combustion is with amounts of oxygen and fuel more nearly in balance, for example with only a small excess of oxygen, problems arise with incomplete combustion. This can result in excessive amounts of carbon monoxide and/or incompletely burned fuel, which may show up as unburned hydrocarbons, soot, and the like. Incomplete combustion lowers the combustion efficiency and can also contaminate the equipment. In the case of internal combustion engines, unburned hydrocarbons, carbon monoxide, and oxides of nitrogen, generally symbolized by the formula $NO_x$, are serious atmospheric pollutants as they give rise to photochemical smog and the like. Contamination of nitrogen oxides from an internal combustion engine usually results when combustion temperature is high.

It has been proposed in the past to introduce streams of water into a burner or to inject water into an internal combustion engine as it operates. This has proven to reduce somewhat incompletely burned fuel desposited in the form of carbon, and in the case of internal combustion engines this can lower nitrogen oxide production and also in certain cases, such as aircraft piston engines, permit operating for short times at higher power outputs with very rich mixtures which would otherwise burn up the engine. Water injection, however, has serious drawbacks.

Problems have arisen in the control of relative amounts of water and fuel precisely, and even if the control is maintained to a satisfactory degree, efficiency drops because the water has to be vaporized.

It has also been proposed to produce an emulsion of hydrocarbon fuel and water by sonic vibration and then to burn this emulsion in a burner. This is described, for example, in the U.S. Pat. to Duthion, No. 3,658,302, Apr. 25, 1972. The Duthion patent utilizes a form of sonic agitation produced by impinging a jet of the liquids against the edge of a blade free to vibrate. This form of sonic device is known in the art as a liquid whistle and was developed by the inventor of the present application, whose earliest U.S. Pat. is No. 2,657,032, Oct. 1953. While the emulsion produced is capable, in some cases, of being burned in a burner, particularly when a considerable amount of surfactant is added, it does not burn completely and produces an amount of heat which is usually less than that obtained by burning the fuel content because with the poor quality of emulsion the heat required to vaporize the water reduces the efficiency.

The present invention deals with an improved water-in-oil emulsion with which much higher efficiency is produced.

SUMMARY OF THE INVENTION

The present invention burns a sonically emulsified, extremely fine water-in-oil emulsion, normally of hydrocarbonaceous fuel, in which the water droplets are of extremely fine particle size. The emulsion is effected by sonic generator coupled to an acoustic transformer, with a larger cross-section coupled to or in contact with the sonic generator than at its other end where the emulsion of the present invention is produced. Because the sonic energy is distributed over a much smaller area, the energy density is greatly increased. Since the sonic generator is operated at a fixed, predetermined frequency, the transformation in the transformer causes the velocity of movement and also its path length at the small end to be increased in order to comply with the law of conservation of energy. For this reason the acoustic transformers of the type described above are often referred to in the art as velocity transformers and the two terms are synonymous. The small end of the acoustic transformer emulsifies fuel and water in a restricted space through which the two liquids flow. Energy densities of about an order of magnitude greater than those obtainable in the liquid whistle type of sonic agitator are readily obtained and produce an emulsion which is not only burnable but which when burned produces combustion efficiency such that the yield of useful heat, from say a conventional boiler, is almost the same as if pure oil had been burned. Therefore, improvements in efficiency of 10% to 30% are not uncommon. When used in an internal combustion engine, flame temperature is decreased but the total amount of power produced by the engine is as great as by burning a comparable amount of unemulsified fuel. The invention is not limited in its broadest aspect to a water content of from 10% to 30% water as emulsions having up to 50% water are still burnable though they do not produce as much heat as would be obtained by burning the same total quantity of unemulsified fuel. As is well known, acoustically it makes no difference whether the acoustic or velocity transformer has its large end in contact with the sonic generator or whether it is coupled to the sonic generator, for example through a resonant metal bar. In the claims the term "coupling" or coupled is used generically wherever the sonic energy is transmitted, substantially without loss, from the sonic generator to the large end of the transformer and is not limited to actual physical contact of the large end with the vibrating crystals or other elements of the sonic generator or through a coupling element.

The water content is not critical within its range, optimum results being obtainable with about 30% of water in an ordinary burner and less when the emulsion is used in an internal combustion engine; for example, optimum results are obtainable with about 18% to 20% water. In every case very clean combustion takes place, minimizing contamination and pollution, and in an internal combustion engine emission controls are readily met.

The surprising result of obtaining as much heat from an emulsion as with unemulsified fuel has been repeatedly tested. While I do not want to limit the present invention to any particular theory of why this suprising result takes place, it seems probable that the combustion of the emulsion in which the microscopic water globules explode into steam is more complete. The surfaces of a furnace or boiler encountering the flame may be below the condensation point of water or above, the latter being more common unless hot water at fairly low temperature is to be produced. In the case of an internal combustion engine temperature, the inner surfaces of the cylinder and the top of the piston are always above the condensation point of water when the engine is operating. The tests made and described in a later portion of the specification were with furnaces and engines where the surfaces were at a temperature higher than the condensation temperature of water, and therefore the improved results do not depend on the condensation of water vapor on cooler surfaces.

I also do not want to limit the invention to any particular theory of why the optimum water contents are somewhat lower for an internal combustion engine than for a burner in an ordinary heating furnace. A possible explanation might be that the heating oils have an average boiling point above that of water and, therefore, in the flame are completely exploded into steam without significant vaporization of the hydrocarbon fuel. In the case of gasoline used in the internal combustion engine tests, which will be described below, the average boiling point of gasoline is lower than that of water, and therefore it is possible that there may be some vaporization of gasoline during combustion before all of the water has been flashed into steam. There has been no rigorous proof of the above explanations but they are plausible possibilities and may well be part or all of the explanations of the surprising results obtained by the present invention.

In the internal combustion engine modification of the present invention, while the total amount of power may be as great or, under certain circumstances, even greater, the peak flame temperature is usually lower, and it seems probable that the reduced emission of nitrogen oxide results primarily from this factor. However, this is not known, and the water vapor present in larger amounts as compared to carbon dioxide may also play a part. Therefore, it is not intended to limit the invention to any particular theory, and the above statements are made because I think the factors mentioned are at least some, and conceivably the only, factors involved.

The invention is not limited to the time in the whole operation when the very fine water-in-oil emulsion is actually produced. This may be at the point where atomization takes place just prior or at the point of ignition. This, however, is not necessary, and the emulsion may be preformed and conveyed to the burner nozzle in a preformed state. The emulsions obtained by sonic agitation including the acoustic transformer are quite stable and so they can be produced at a point remote from the actual burner itself, and such a modification is, of course, included. It is also possible to have the emulsion formed by flowing water and oil over the emulsifying point, preferably the end of a sonic probe, so that the emulsion is formed at the same place, or practically at the same place, as atomization into the flame takes place. In the case of the use of sonic atomization, particularly for internal combustion engine use, which is described and claimed in my co-pending application, U.S. Pat. No. 3,756,575, issued Sept. 4, 1973, referred to above, it is usually preferable to have the streams of water and fuel unite just prior to the point of atomization.

It is an important advantage of the present invention that it is not necessary to use any emulsifying agent, particularly when sonic emulsification is used. This eliminates the added step and, therefore, cost of the emulsion is reduced, although in a broader aspect the present invention does not exclude an emulsion which has been made in the presence of a small amount of an emulsifying agent, such as a small amount, usually a fraction of a percent, of a dialkyl sulfosuccinate or other well known emulsifying agent capable of facilitating the formation of water-in-oil emulsions. The invention in this aspect, which is normally not preferred, may use any known emulsifying agent.

Ordinarily more problems are presented with the burning of heavy residual fuel oil, and this frequently requires steam heating. In the case of the present invention, however, the heavy oil emulsifies more readily than light oil, and when emulsified with a considerable amount of water, the viscosity is low enough so that it may be burned without preheating, or with less preheating, or at a lower temperature where cold water is added. This is an additional advantage for use with heavier oils. Why the heavy oil emulsifies more readily and to a lower viscosity has not been fully determined. It is possible that the heavy fuel oil contains contaminants which aid in the emulsification which are not present in the purer lighter fuel oils. It is not intended, however, to limit the present invention to any theory of action.

BRIEF DESCRIPTION OF THE DRAWINGS

FIG. 1 shows, in diagrammatic form, a sonic emulsifier and a burner;

FIG. 2 is a detail on a somewhat enlarged scale, partly in section, of the emulsifier;

FIG. 3 is a semi-diagrammatic illustration of a combined sonic atomizer and emulsifier, especially useful with internal combustion engines.

DESCRIPTION OF THE PREFERRED EMBODIMENTS

Figure 4:
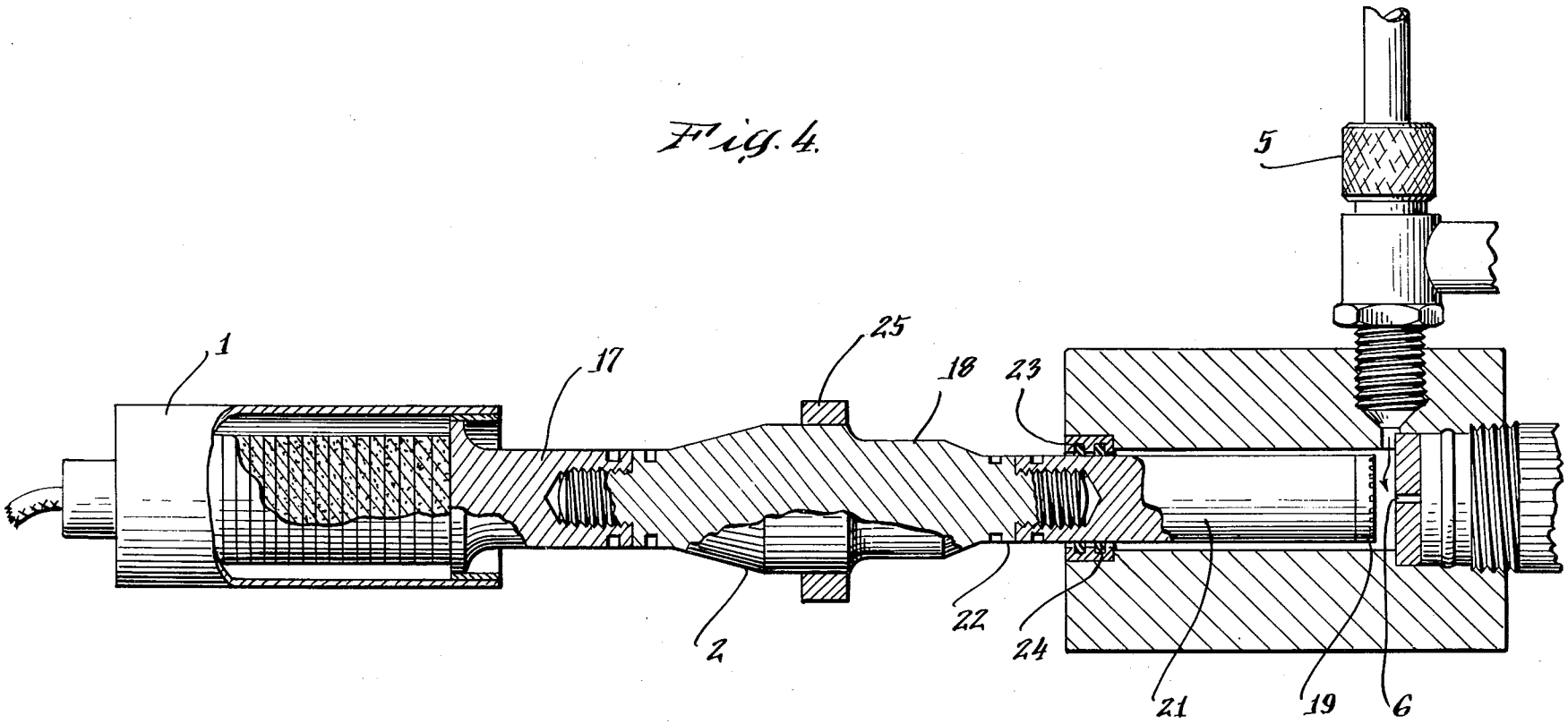
FIG. 4 is a cross-section through a modified form of sonic probe.

In FIG. 1 a sonic generator 1 is shown powering a sonic probe in the form of an acoustic transformer 2, the end 9 of which extends into a chamber 3 through a flexible seal 4 located substantially at a nodal point of the sonic probe. A stream of fuel, such as house heating fuel oil, is introduced through a conduit 5 and a stream of water joins it through a conduit 7 with a fail safe valve opened by fuel pressure. These two streams strike the vibrating end 9 of the sonic probe, as can best be seen in FIG. 2 where a portion of the chamber 3 is shown in section. The violent sonic agitation emulsifies the two streams, which then leave axially through an outlet conduit 6 in a plate 10 which is located closely adjacent to the vibrating end 9 of the sonic probe. From the outlet conduit 6 the emulsion passes into a conventional burner 8 in a combustion chamber, (not shown). Air is introduced at 26 and a flame results. While the proportions of fuel and water can vary over a wide range, for example from about 10% to about 50% water, a very suitable mixture is about 70% fuel and 30% water.

The sonic probe is of conventional design with a stack of piezoelectric plates, (not separately shown), which are energized through the cable 12 by a suitable high frequency oscillator, (not shown), which may operate, for example, at a frequency of approximately 20,000 HZ. The plate 9 at the end of the sonic probe 2 may be a flat plate or it may also be provided with a suitable baffle, for example a spiral baffle, to extend the period of residence in the violent sonic agitation field. The sonic generator illustrated diagrammatically is of a common commercial type sold by the Branson Instruments under their trade name "Sonifier." The particular design of the sonic emulsifier has nothing to do with the present invention and the illustration shows merely a typical one. The combination of the sonic generator and acoustic transformer is essential to produce the increased energy density on which the results of the present invention depend. However, the invention may use any other design having a sonic generator and an acoustic transformer producing comparable energy densities.

FIG. 4 illustrates a more recently developed Sonifier by Branson Instruments which has certain practical advantages, at least for larger burners. It is shown in cross-section. 1 is the generator, which is a stack of conventional piezoelectric crystals. These crystals are not of as large cross-section as the corresponding generator in FIGS. 1 and 2 because they are coupled to an acoustic transformer, which, as it performs the same function as the transformer in FIGS. 1 and 2, bears the same reference numeral 2. The coupling is through a half-wave resonant rod 17, which couples to the large end of the acoustic or velocity transformer 2. The large end is shown at 18, and the transformer can be clamped by the flange 25 where additional rigidity is desirable since the modified Sonifier is considerably longer in length than that shown in FIGS. 1 and 2. The small end 32 of the transformer is bolted to and therefore coupled to a rod 21 at the end of which there is the same kind of plate 19 as is shown in FIGS. 1 and 2. The rod is provided with lands 24 and elastomeric rings 23. This is the portion which is at an approximate quarter wavelength and which seals the container where the emulsion is produced. This container and associated elements are the same as in FIGS. 1 and 2. Therefore, they are not repeated in FIG. 4. The modified Sonifier has the advantage that it is not limited to a single size of acoustic transformer and can be used with transformers of various cross-sectional ratios. Also, it is provided with a clamping flange 25, as has been described, which permits much more rigid construction and makes it suitable for a longer probe. The operation is exactly the same. The vibrations produced by the vibrating crystals are coupled to the acoustic transformer 2 and the energy density is increased in the same way as by the transformer in FIGS. 1 and 2.

The equipment of FIGS. 1 to 4 produce the same increased energy density at the small end of the probe. It should be noted that this is energy density, i.e. violence of agitation, which is effected by longer paths, hence the alternative name of velocity transformer. It is energy density which is required in the present invention and not total power input. As has been stated earlier, the energy density is about an order of magnitude greater than can be produced in a liquid whistle, and in the probes of FIGS. 1 to 4, for illustration, this energy density is approximately 37 watts/cm$^2$.

As illustrated and described above, stable fuel and water emulsions of the water-in-oil type are produced, and when these emulsions are burned combustion results in a boiler were measured in relative times to bring the water in the boiler jacket from a particular temperature to a temperature just below its boiling point. The test accurately measures the relative heating efficiencies and is shown in the following table, which illustrates the results of eight tests, test 1 to 5 being with straight No. 2 domestic heating oil and tests 6, 7 amnd 8 with a mixture of oil and water.

| | TEMPERATURE (1) | | TEMPERATURE (2) | | TIME | MATERIAL |
|---|---|---|---|---|---|---|
| 1. | 150 | degrees | 192 | degrees | | Oil |
| 2. | 150 | " | 194 | " | 4–13" | Oil |
| 3. | 150 | " | 194 | " | 4–14 | Oil |
| 4. | 146 | " | 192 | " | 4–6 | Oil |
| 5. | 144 | " | 194 | " | 3–40 | Oil |
| 6. | 146 | " | 194 | " | 3–30 | 600 Oil<br>325 Water |
| 7. | 144 | " | 192 | " | 4–20 | 850 Oil<br>200 Water |
| 8. | 144 | " | 196 | " | 4–16 | 800 Oil<br>250 Water |

Boiler surfaces were carefully examined in the tests and were clean. A flame was produced which was whiter; there was no visible smoke from the chimney, and stack gas analysis showed a more complete and perfect combustion.

Tests were made comparing water-in-oil emulsions produced in a standard commercially available liquid whistle which is similar to the design described in the first Cottell U.S. Pat. No. 2,657,021, referred to above, with emulsions produced by emulsifiers used in the present invention and described in FIGS. 1 to 3. Liquid pressure in the liquid whistle was 200 psi and the energy density level in the sonic emulsifiers was approximately 37 watts/cm$^2$ or about an order of magnitude greater than in the liquid whistle. The tests with various amounts of water and No. 2 heating oil were compared in two respects, one, stability, i.e. time for onset of emulsion inversion, and, two, flame characteristics.

| Water in Oil Emulsion Water % | Liquid Whistle Time for Onset of Inversion | Ultrasonic Fuel Reactor Time for Onset of Inversion | Remarks on Combustion of Liquid Whistle Emulsion | Remarks on Combustion of Ultrasonic Fuel |
|---|---|---|---|---|
| 5% | 5" | 180" | Intermittent flame Flame out in app. 8 sec. Smoke, possibly due to combustion failure | Bright, consistent flame, no smoke |
| 10% | 3" | 150" | Intermittent flame Flame out in app. 3 | Bright, consistent flame, no smoke |

-continued

| Water in Oil Emulsion Water % | Liquid Whistle Time for Onset of Inversion | Ultrasonic Fuel Reactor Time for Onset of Inversion | Remarks on Combustion of Liquid Whistle Emulsion | Remarks on Combustion of Ultrasonic Fuel |
|---|---|---|---|---|
| | | | sec. Smoke, possibly due to combustion failure | |
| 20% | 5" | 142" | Intermittent flame Flame out in app. 2 sec. Smoke, possibly due to combustion failure | Bright, consistent flame, no smoke |
| 30% | 6" | 140" | Intermittent flame Flame out in app. 3 sec. Smoke, possibly due to combustion failure | Bright, consistent flame, no smoke |

It will be seen that at all water contents much more stable emulsions were produced in the ultrasonic fuel reactor of the present invention and the flame was excellent whereas emulsions from the liquid whistle produced intermittent flame accompanied by smoke, and in the operation flame out actually occurred.

FIG. 3 illustrates a modification particularly useful for internal combustion engines. The ultrasonic probe carries the same reference numerals as in FIGS. 1 and 2, but the shape of the end of the probe is a little different, being expanded out into a plate 10. Gasoline was introduced through the conduit 14 into an annular space between the probe and a housing 15, and water was introduced through conduit 13. The two liquids flow down until they come to the edge of the expanded plate 10, where they proceed to flow along the top of the plate and are atomized and emulsified at the same time. Air is introduced adjacent the atomized emulsion through an air conduit 16 and the resulting mixture is fed into the manifold of an internal combustion engine, (not shown).

The plate 10 projects beyond the housing, the clearance between housing and ultrasonic probe being exaggerated and the violent sonic agitation of the plate throws a finely divided emulsion up from the upper surfaces of its projection. As FIG. 3 is designed to connect with a manifold of an internal combustion engine, there will usually be a certain amount of vacuum, and this causes the emulsion to be pulled around the edge of the plate, as is shown by the arrows. Thorough mixing of the air takes place, but it is not necessary that the emulsion be thrown by sonic vibration into the manifold, whereas in FIG. 4 with the horizontal burner this is necessary so that the fine emulsion atomized in the blast of air moves horizontally to form the burner flame. It is for this reason that the actual contact of the plate with the film of fuel and water flowing over it is on its forward face so that it will be thrown in the direction to form the burner flame, for of course in an ordinary burner there is not the vacuum which exists in an internal combustion engine manifold.

The internal combustion engine fed with a gasoline and water emulsion atomized into the air ran with the same power as on straight gasoline, and pollutants were reduced, unburned hydrocarbons practically zero, carbon monoxide greatly reduced, and nitrogen oxides still more reduced. The figures illustrate the pollutant concentrations, the engine running at about 5,000 rpm under load. It will be noted that the pollutant concentrations are far below present emission standards and even meet more rigid standards proposed for later years. Carbon monoxide 0.94% unburned hydrocarbons 0.0, nitrogenoxides 11.35 ppm.

I claim:

1. A process of burning liquid fuel comprising, in combination, generating sonic vibrations, amplifying the energy density thereof by acoustic transformation which distributes the sonic power over a reduced area providing a narrow restrictive zone at the point of amplifying sonic energy density, the restricted zone being between the end of the acoustic transformer, which effects the acoustic transformation, and a stationary element which acts as an anvil, introducing water and liquid fuel in a thin film in said restricted zone whereby the water and oil are subjected to the sonic vibration of amplified energy density and whereby a water-in-oil emulsion of fine particle size is produced, the water being in the range of 10% to 50% of the total fuel and water, and burning said emulsion.

2. A process according to claim 1 in which the water content of the emulsion is from 10% to 30%.

3. A process according to claim 2 in which the emulsion is atomized and mixed with air and introduced into the cylinder of an internal combustion engine.

4. A process according to claim 1 in which the fuel and water emulsion produced is mixed with air, atomized, and burned in a heating burner.

5. A process according to claim 2 in which the fuel and water emulsion produced is mixed with air, atomized, and burned in a heating burner.

* * * * *